US006022835A

United States Patent [19]

Fletcher

[11] Patent Number: 6,022,835

[45] **Date of Patent: *Feb. 8, 2000**

[54] LUBRICATING COMPOSITION

[75] Inventor: Robert Anthony Fletcher, Chester, United Kingdom

[73] Assignee: Shell Oil Company, Houston, Tex.

[ * ] Notice: This patent is subject to a terminal disclaimer.

[21] Appl. No.: 09/169,870

[22] Filed: Oct. 12, 1998

[30] Foreign Application Priority Data

Oct. 22, 1997 [EP] European Pat. Off. ..... 97308380

[51] Int. Cl.[7] ..... C10M 135/18

[52] U.S. Cl. ..... 508/365; 508/371; 508/385

[58] Field of Search ..... 508/365, 363, 508/368, 371, 385

[56] References Cited

U.S. PATENT DOCUMENTS 5,512,188 4/1996 Kinoshita ..... 508/365

5,650,380 7/1997 Fletcher ..... 508/168

*Primary Examiner*—D. Gabrielle Brouillette

*Assistant Examiner*—Cephia D. Toomer

[57] ABSTRACT

A lubricating composition comprising a base oil in combination with molybdenum dithiocarbamate, zinc naphthenate and one or more metal dithiophosphates, and optionally one or more metal dithiocarbamates. A lubricating grease comprising such a composition in combination with a thickener, is particularly suitable for lubricating constant velocity joints.

18 Claims, No Drawings

LUBRICATING COMPOSITION

FIELD OF THE INVENTION

The present invention relates to lubricating compositions, to lubricating greases containing such compositions, and to lubricating greases for use in constant velocity joints such as constant velocity plunging joints.

BACKGROUND OF THE INVENTION

Constant velocity joints are used in front engine/front wheel drive cars, in cars with independent suspension, or in 4-wheel drive vehicles. The constant velocity joints (CVJs) are special types of universal couplings which transmit drive from the final reduction gear to a road wheel axle at constant rotational velocity. The two major categories of constant velocity joint are plunging and fixed constant velocity joints and are usually used in a vehicle in suitable combinations. The plunging CVJs allow sliding in the axial direction, while fixed CVJs do not permit movement in the axial direction. The mechanical components of plunging joints undergo complex rolling and sliding motions when the joint is at an angle and undergoing rotation and it is known that the frictional resistance to these motions can cause the motor vehicle to suffer vibrations, acoustic beating noises, and small rolling motions, particularly under certain driving conditions. Such noise, vibrations, and motions can be unpleasant to the vehicle occupants.

Accordingly, attempts have been made to formulate CVJ greases to improve their frictional characteristics so as to reduce the frictional forces within plunging constant velocity joints and noise and vibrations experienced in cars. A number of studies have shown there to be useful correlations between these noises and vibrations and the friction coefficients measured in certain laboratory friction testers. In particular, the SRV (Schwingungs Reibung und Verschleiss) laboratory friction tester (manufactured by Optimol Instruments) has been found in a number of studies to provide a useful guide in the development of low friction constant velocity joint greases for improved noise and vibration.

Examples of lubricating greases commonly used in such constant velocity joints include a grease comprising a calcium complex soap as a thickening agent; a grease comprising a lithium soap as thickening agent; a grease comprising a lithium complex as thickening agent; and a grease comprising a polyurea as thickening agent. However, thickeners may also be one of a variety of materials, including clays, and fatty acid soaps of calcium, sodium, aluminium, and barium.

The base oils used in lubricating greases are essentially, the same type of oil as would normally be selected for oil lubrication. The base oils may be of mineral and/or synthetic origin. Base oils of mineral origin may be mineral oils, for example produced by solvent refining or hydroprocessing. Base oils of synthetic origin may typically be mixtures of $C_{10-50}$ hydrocarbon polymers, for example liquid polymers of alpha-olefins. They may also be conventional esters for example polyol esters. The base oil may also be a mixture of these oils. Preferably the base oil is that of mineral origin sold by the Royal Dutch/Shell Group of Companies under the designations "HVI" or "MVIN", is a polyalphaolefin, or a mixture thereof. Base oils of the type manufactured by the hydroisomerisation of wax, such as those sold by the Royal Dutch/Shell Group of Companies under the designation "XHVI" (trade mark) may also be included.

The lubricating grease preferably contains 2 to 20% by weight of thickener, preferably 5 to 20% by weight.

Lithium soap thickened greases have been known for many years. Typically, the lithium soaps are derived from $C_{10-24}$, preferably $C_{15-18}$, saturated or unsaturated fatty acids or derivatives thereof. One particular derivative is hydrogenated castor oil, which is the glyceride of 12-hydroxystearic acid.

12-hydroxystearic acid is a particularly preferred fatty acid.

Greases thickened with complex thickeners are well known. In addition to a fatty acid salt, they incorporate into the thickener a complexing agent which is commonly a low to medium molecular weight acid or dibasic acid or one of its salts, such as benzoic acid or boric acid or a lithium borate.

Urea compounds used as thickeners in greases include the urea group (—NHCONH—) in their molecular structure. These compounds include mono-, di- or polyurea compounds, depending upon the number of urea linkages.

Various conventional grease additives may be incorporated into the lubricating greases, in amounts normally used in this field of application, to impart certain desirable characteristics to the grease, such as oxidation stability, tackiness, extreme pressure properties and corrosion inhibition. Suitable additives include one or more extreme pressure/antiwear agents, for example zinc salts such as zinc dialkyl or diaryl dithiophosphates, borates, substituted thiadiazoles, polymeric nitrogen/phosphorus compounds made, for example, by reacting a dialkoxy amine with a substituted organic phosphate, amine phosphates, sulphurised sperm oils of natural or synthetic origin, sulphurised lard, sulphurised esters, sulphurised fatty acid esters, and similar sulphurised materials, organo-phosphates for example according to the formula $(OR)_3$ P=O where R is an alkyl, aryl or aralkyl group, and triphenyl phosphorothionate; one or more overbased metal-containing detergents, such as calcium or magnesium alkyl salicylates or alkylarylsulphonates; one or more ashless dispersant additives, such as reaction products of polyisobutenyl succinic anhydride and an amine or ester; one or more antioxidants, such as hindered phenols or amines, for example phenyl alpha naphthylamine, diphenylamine or alkylated diphenylamine; one or more antirust additives such as oxygenated hydrocarbons which have optionally been neutralised with calcium, calcium salts of alkylated benzene sulphonates and alkylated benzene petroleum sulphonates, and succinic acid derivatives, or friction-modifying additives; one or more viscosity-index improving agents; one or more pour point depressing additives; and one or more tackiness agents. Solid materials such as graphite, finely divided $MoS_2$, talc, metal powders, and various polymers such as polyethylene wax may also be added to impart special properties.

Studies with oil soluble molybdenum dithiocarba-mates (MoDTC's) (PCH Mitchell, Wear 100 (1984) 281; H Isoyama and T Sakurai, Tribology International 7 (1974) 151; E R Braithwaite and A B Greene, Wear 46 (1978) 405; and Y Yamamoto and S Gondo, Tribology Trans., 32 (1989) 251) and with other organomolybdenum compounds in the presence of sulphur containing materials (Y Yamamoto, S Gondo, T Kamakura and M Konishi, Wear 120 (1987) 51; Y Yamamoto, S Gondo, T Kamakura and N Tanaka, Wear 112 (1986) 79; A B Greene and T J Ridson SAE Technical Paper 811187 Warrendale Pa., 1981; and I Feng, W Perilstein and M R Adams ASLE Trans., 6 (1963) 60) have been shown to be effective in reducing friction and wear. The presence of molybdenum in combination with sulphur (A. B. Greene and T. J. Ridson SAE Technical Paper 811187 Warrendale Pa., 1981), and possibly phosphorous (Y Yamamoto, S Gondo, T Kamakura and M Konishi, Wear 120 (1987) 51), appear to be necessary conditions for the achievement of low friction. The source of sulphur may be from an additive used in combination with the molybdenum compound (K Kubo, Y Hamada, K Moriki and M Kibukawa, Japanese Journal of Tribology, 34 (1989) 307), commonly zinc dithiophosphate (ZnDTP), from the base oil used (Y Yamamoto, S Gondo, T Kamakura and N Tanaka, Wear 112 (1986) 79) or through chemical combination with the molybdenum compound itself (as is the case for MoDTC).

However there are many instances in the literature where the addition of organomolybdenum—sulphur compounds to oils produced no reduction in friction. The source of sulphur used in combination with the organomolybdenum appears to be critical; some ZnDTP types produce a fall in friction, while others cause a rise in friction (K Kubo, Y Hamada, K Moriki and M Kibukawa, Japanese Journal of Tribology, 34 (1989) 307).

In an NTN study (SAE Technical Paper 871985; The Development of Low Friction and Anti-Fretting Corrosion Greases for CVJ and Wheel Bearing Applications, M Kato and T Sato of NTN Toyo Co Ltd), the largest reduction in friction was found when molybdenum dithiophosphate (MoDTP) was included with ZnDTP in a polyurea base grease. The addition of MoDTC together with ZnDTP to polyurea grease brought about a smaller reduction in friction.

WO 97/03152 discloses a lubricating composition comprising a base oil, molybdenum disulphide, zinc naphthenate and zinc dithiophosphate, and optionally zinc dithiocarbamate. There is no information in this document from which can be derived that the combination of compounds according to the present invention, is a good friction reduction agent.

SUMMARY OF THE INVENTION

The present invention relates to a lubricating composition comprising a base oil in combination with molybdenum dithiocarbamate, zinc naphthenate and one or more metal dithiophosphates, and optionally one or more metal dithiocarbamates. A lubricating grease comprising such a composition in combination with a thickener, is particularly suitable for lubricating constant velocity joints.

DETAILED DESCRIPTION OF THE PRESENT INVENTION

In accordance with the present invention, it has been discovered that the addition of zinc naphthenate to an MoDTC and metal dithiophosphate combination can improve the friction properties of these additives. This effect is surprising because the addition of zinc naphthenate to molybdenum dithiocarbamate alone does not yield a reduced friction co-efficient and in fact shows a rise in the friction co-efficient.

Accordingly, it has surprisingly been found that a molybdenum dithiocarbamate, a metal dithiophosphate and zinc naphthenate in combination work synergistically as a friction reducing agent in lubricating compositions, especially greases, whilst retaining good, low anti-wear properties. Tested against the use of molybdenum dithiocarbamate alone or in combination with one of the two other components, the friction reduction is shown to be quite unexpected.

The first aspect of the present invention accordingly provides a lubricating composition which comprises a base oil and, as a friction reducing additive package, a combination of molybdenum dithiocarbamate, zinc naphthenate and one or more metal dithiophosphates, and optionally one or more further metal dithiocarbamates.

Preferably the molybdenum dithiocarbamate is a sulphurised oxymolybdenum dithiocarbamate of the general formula:

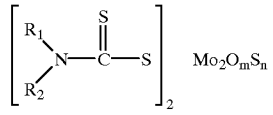

where the four possible R groups $R_1$, $R_2$, $R_3$ and $R_4$ (only $R_1$ and $R_2$ are shown) in the generalised structure may be the same or different and $R_1$–$R_4$ are each a $C_1$–$C_{30}$ hydrocarbon or a hydrogen.

Preferably, m+n=4, and m and n may or may not be whole numbers.

Preferably, $R_1$–$R_4$ each independently represents a primary or secondary alkyl group having 1 to 24 carbon atoms, cycloalkyl groups having 6 to 26 carbon atoms, or an aryl or an alkylaryl group having 6 to 30 carbon atoms, or hydrogen.

$R_1$–$R_4$ may be chosen to influence the solubility of the MoDTC.

The metal in the metal dithiophosphates and/or metal dithiocarbamates is, preferably, independently selected from zinc, molybdenum, tin, manganese, tungsten and bismuth.

Preferably, the one or more metal dithiophosphates is/are selected from zinc dialkyl-, diaryl- or alkylaryl-dithiophosphates, and the one or more metal dithiocarbamates is/are selected from zinc dialkyl-, diaryl- or alkylaryl-dithiocarbamates, in which dithiophosphates and/or dithiocarbamates any alkyl moiety is straight chain or branched and preferably contains 1 to 12 carbon atoms.

In accordance with the present invention there is also provided a lubricating grease comprising a thickener in combination with a lubricating composition according to the present invention.

In the lubricating grease according to the present invention, preferably the weight ratio of molybdenum in molybdenum dithiocarbamate to total metal dithiophosphate is in the range of 2:1 to 1:20 and the weight ratio of metal dithiophosphate to zinc naphthenate is in the range of 0.85:10 to 0.85:0.05 and the weight ratio of molybdenum in the molybdenum dithiocarbamate to zinc in zinc naphthenate is in the range of 15:1 to 1:4.

More preferably, with oil soluble molybdenum dithiocarbamate, the weight ratio of molybdenum in molybdenum dithiocarbamate to the metal dithiophosphate is in the range of 0.8:1.7 to 0.14:1.7 and the weight ratio of metal dithiophosphate to the zinc naphthanate is in the range of 0.85:4.8 to 0.85:0.6 and the weight ratio amount of molybdenum in molybdenum dithiocarbamate to the zinc in zinc naphthanate is in the range 5:1 to 1:1.6.

More preferably, with oil insoluble molybdenum dithiocarbamate, the weight ratio of molybdenum in molybdenum dithiocarbamate to the metal dithiophosphate is in the range of 1:1 to 1:6.2 and the weight ratio of metal dithiophosphate to the zinc naphthanate is in the range of 0.85:4.8 to 0.85:0.6 and the weight ratio of molybdenum in molybdenum dithiocarbamate to the zinc in zinc naphthenate is in the range of 10.3:1 to 1:0.8.

In the above, zinc napthenate, typically, represents a complex mixture of napthenic acids derived from selected crude oil fractions, typically, by reaction of the fraction with sodium hydroxide solution, followed by acidification and purification. Preferably, the napthenic acids, prior to reaction with a zinc compound, have molecular weights within the range of 150–500, more preferably 180–330. Preferably, the elemental zinc content in the zinc naphthenate mixture is between 1–25%, more preferably, 5–20%, most preferably 9.0–15.4%.

The lubricating grease according to the present invention preferably contains molybdenum from molybdenum dithiocarbamate in the amount of 0.04 to 2.5% by weight (Mo), more preferably, with oil soluble molybdenum dithiocarbamate, 0.08 to 0.6% by weight (Mo), and, with oil insoluble molybdenum dithiocarbamate, 0.08% to 1.4% by weight (Mo). It further, preferably, contains said one or more metal dithiophosphates in the total amount of 0.1 to 10% by weight, more preferably, 0.3% to 3.5% by weight. Still further it contains zinc naphthenate in the amount of 0.05% to 12.0% by weight, more preferably, 0.3% to 3.5% by weight.

The friction reducing additive agent according to the present invention does not need to contain molybdenum disulphide. Moreover, it is preferred that the lubricating compositions according to the present invention contain no substantial amount of molybdenum disulphide. More specifically, it is preferred that the lubricating compositions contain less than 0.5% wt of molybdenum disulphide, more preferably less than 0.3% wt of molybdenum disulphide, most preferably no molybdenum disulphide.

The thickener preferably comprises a urea compound, a simple lithium soap or a complex lithium soap. A preferred urea compound is a polyurea compound. Appropriate thickeners are well known in lubricant grease technology.

In accordance with the present invention there is further provided a method of lubricating a constant velocity joint comprising packing it with lubricating grease according to the present invention.

In accordance with the present invention there is still further provided a constant velocity joint packed with a lubricating grease according to the present invention.

Preferably, the constant velocity joint is, generally, a plunging constant velocity joint but may, for instance, include high speed universal joints, which may include fixed or plunging types of constant velocity joints, or Hooke's type universal joint.

The molybdenum dithiocarbamate (MoDTC) used in additive packages are often oil insoluble, possibly present in the greases as a finely dispersed solid.

However, solid dispersed additives can separate from a grease in service. This effect has been experienced with greases containing solid additives in some severe high temperature/high speed CVJ tests. This potential problem of centrifugation of solids from greases is particularly acute in universal joints incorporated into high speed propeller shaft (HSPS) applications, where very high rotation speeds (around 4–6000 rpm) are common. Greases using all-oil soluble additive packages would not suffer from this problem.

High molybdenum and high sulphur levels are generally required to give good friction reduction. However, high molybdenum and sulphur levels increase the insolubility of the composition.

A further aspect of the present invention is, therefore, the provision of a lubricating composition which comprises a base oil and, an oil soluble friction reducing additive package comprising a combination of molybdenum dithiocarbamate, zinc naphthenate and one or more metal dithiophosphates.

The use of an all-oil soluble low friction package allows the development of CVJ greases for high speed applications without risk of centrifugation and separation of solid additives. Additionally, in constant velocity plugging joint grease applications, it makes it possible to use stiff greases, which retain adequate stiffness in service and yet still provide high lubrication penetrating power.

The use of an effective all-oil soluble low friction package allows the development of greases for universal joints in high speed propeller shaft applications. It can also be used in lubricating compositions for plunging joint applications, so yielding constant velocity joint greases that have high lubrication penetrating power. Optionally, one or more further metal dithiocarbamates may be incorporated into the additive package. Additionally, the additive may include non-oil soluble components.

Preferred is the use of the friction reducing additive combination in a lubricating grease which comprises a base oil and a thickener, which is preferably a lithium soap, lithium complex, or a urea compound.

Such a lubricating grease, preferably, independently, contains components of the type and, preferably, amounts and, preferably, relative amounts set out in respect of the preferred features of the first aspect of the invention.

The present invention will now be described by reference to the following examples which are included for illustrative purposes only and are in no way meant to limit the present invention.

EXAMPLES

Additives and Base Grease

Table 1 details some of the key molybdenum dithiocarbamate (MoDTC) compounds that are commercially available. The two MoDTC compounds with a high molybdenum content (MoDTC(3) and MoDTC(4)) are solids, and are for the most part insoluble in oil.

Other additives used in the examples are:

| | |
|---|---|
| ZnDTP (1) | Primarily zinc dithophosphate (ZnDTP); largely isobutyl ZnDTP |
| ZnDTP (2) | an 85% solution of largely isobutyl ZnDTP (1) in mineral oil |
| ZnNa (1) | zinc naphthenate solution (8% zinc); containing approximately 60% zinc naphthenate in mineral oil |
| Amine phosphate/ thiophosphates | Mixed amine phosphate/thio-phosphates, at a 50% weight dilution in mineral oil. |
| Sulphurised Olefin | Highly sulphurised olefin (43% sulphur) |
| ZnDTC | Zinc diamyl dithiocarbamate (6% zinc) |

The analysis was carried out largely by including the additives into a fully formulated polyurea grease (PUG). The additive package has also been included into lithium soap and lithium complex thickened base greases, and into a semi-synthetic diurea grease. Details of the greases are given in footnotes to the relevant tables of data.

Measurement of Friction Coefficient and Wear

An oscillating SRV friction tester from Optimol Instruments was used for all of the friction and wear measurements, with a 10 mm ball on a flat lapped surface as test geometry. Friction coefficients were recorded after two hours of operation under fixed text conditions. The fixed test conditions were a load of 300 Newtons, an oscillation frequency of 50 Hertz, a stroke of 1.5 mm, and a temperature setting of 100° C.

Wear was assessed by measuring the diameter of the wear scar on the ball at the end of each two hour period using an optical graticule.

The results are set out in Tables 2–13.

Development of an Oil Soluble MoDTC-Based Formulation

Examples 1–5

Comparison Between MoDTC(2) and MoDTC(1)

To provide a baseline for comparison the friction coefficients measured on several commercial greases (Examples 1–5), Reference Greases (RG), are summarised in Table 2.

Examples 8–39

The friction performance of MoDTC(2) and MoDTC(1) in combination with ZnDTP were compared in PUG grease (Table 3, Examples 8–11). The friction coefficients are generally high (compare RG in Table 2). For the combination 4% MoDTC(1)/1.5% ZnDTP (2) (Example 11), a friction coefficient lower than that of the equivalent MoDTC(2) formulation (Example 10) was recorded, but the coefficient was rising towards the end of the test.

Additive Combinations with MoDTC(2) in PUG

The proportions of ZnDTP and MoDTC used in Table 3 were chosen arbitrarily and it should be understood that these levels are unlikely to be the optimum for low friction. In order to establish the minimum friction coefficient achievable with this combination, the proportion of ZnDTP (2) content was varied 0% through to 50% (Table 4 Examples). The use of MoDTC(2) alone yields quite low friction coefficients, although these are still clearly above those of RG (Table 2).

Table 5 shows that the use of an alternative zinc additive, ZnNa (1) in combination with MoDTC(2) does not yield low friction.

Table 6 shows the effect on friction and wear of varying the proportions of MoDTC(2), ZnNa (1) and ZnDTP (2) in an additive mix containing all three additives. The friction coefficient and wear are dependent on the proportions of these three additives. The optimum levels were further studied by keeping the proportions of ZnNa (1): ZnDTP (2) constant at 2:1, while varying the level of MoDTC(2) from 0% to 12% (Table 7). Tables 6 and 7 and show that both the friction and wear pass through a minimum when the proportions of MoDTC(2), ZnNa (1) and ZnDTP (2) are roughly 4:2:1.

Table 8 shows the effect of varying the total level of the additive package between 3.5% and 14%.

Effect of Incorporating MoDTC(3) in the Optimised Package

Table 9 shows that MoDTC(3) can be added to the new additive package without loss in friction performance. This was also found in formulating Example 39 in a very different base fluid. 1.3% MoDTC(3) contains essentially the same level of elemental molybdenum as 8% MoDTC(2). MoDTC (2) appears to be more effective than MoDTC(3) on an equal molybdenum basis.

Effect on Friction of Including Low Cost Extreme Pressure Additives

It is possible that an extreme pressure additive might improve durability in the more severe CVJ applications. To test the tolerance to such additives, both 1.5% sulphurised olefin and 1.5% Amine phosphate/thiophosphates have been added to PUG containing the package at the 7% level (4% MoDTC(2)).

Including the New Package into Lithium Soap and Lithium Complex Base Greases

All of the optimisation work described above was carried out in PUG. To show the applicability of the additive package to other grease thickener types, the three additives MoDTC(2), ZnNa (1) and ZnDTP (2) in the new additive package were included into both a lithium soap and a lithium complex base grease (Table 11). Detailed descriptions of both greases are given in this table.

Example 39

Table 12 shows that the additive package can be included in a polyurea grease with a very different base oil composition without loss in friction and wear performance. MoDTC(3) is itself an additive with useful extreme pressure properties and it can also be seen from this table that inclusion of MoDTC(3) does not adversely affect the SRV friction and wear performance of the grease.

As indicated above, the grease formulations of the present invention can further comprise one or more additives which impart certain desirable characteristics to formulations. In particular, further extreme-pressure/antiwear agents can be included, such as borates, substituted thiadiazoles, polymeric nitrogen/phosphorus compounds, amine phosphates, sulphurised esters and triphenyl phosphorothionate.

ZnDTC

For comparison, the friction coefficient was measured of a composition containing 3% wt zinc dithiocarbamate, 1.5% wt zinc dithiophosphate (ZnDTP(2)) and 2% wt zinc naphthenate (ZnNa(1)) in a polyurea grease further containing 0.5% wt of antioxidant.

The composition had a coefficient of friction of 0.122.

TABLE 1

Physical and chemical characteristics of some commercially available organomolybdenum compounds

| | MoDTC (1) | MoDTC (2) | MoDTC (3) | MoDTC (4) |
|---|---|---|---|---|
| basic chemical type | MoDTC | MoDTC | MoDTC | MoDTC |
| Molybdenum content % mass | 4.5 | 4.9 | 27.5 | 29.0 |
| sulphur content % mass | 5.7 | Present | 28.0 | 25.0 |
| melting point ° C. | liquid | liquid | 272 | 251 |

TABLE 2

SRV friction performance of several commercial plunging joint greases (RG)

| reference grease | thickener type | coefficient of friction |
|---|---|---|
| 1 | polyurea | 0.098 |
| 2 | polyurea | 0.070 |
| 3 | calcium complex | 0.120 |
| 4 | calcium complex | 0.100 |
| 5 | lithium soap | 0.130 |

TABLE 3

Comparison between the friction performance of MoDTC (2) and MoDTC (1) in admixture with ZnDTP (2) in PUG

| | test grease | Coefficient of friction | Wear scar diameter (mm) |
|---|---|---|---|
| 8 | 1.5% ZnDTP (2)<br>8% MoDTC (2) | 0.123 | 0.63 |
| 9 | 1.5% ZnDTP (2)<br>8% MoDTC (1) | 0.123 | 0.59 |
| 10 | 1.5% ZnDTP (2)<br>4% MoDTC (2) | 0.108 | 0.54 |
| 11 | 1.5% ZnDTP (2)<br>4% MoDTC (1) | 0.085 | 0.56 |

PUG base grease composition

| | |
|---|---|
| thickener:- | 4,4' bis (stearyl ureido) diphenyl methane (12%). |
| additives:- | 0.5% diphenylamine, 0.1% sulphurised olefin, 1.0% barium sulphonate |
| base oil:- | HVI 160B: HVI 650:: 3:1 |
| ZnDTP (2) | |

TABLE 4

Effect of adding ZnDTP (2) to 8% MoDTC (2) in PUG

| | test grease | coefficient of friction | wear scar diameter (mm) |
|---|---|---|---|
| 12 | 8% MoDTC (2)<br>0% ZnDTP (2) | 0.065 | 0.53 |
| 13 | 8% MoDTC (2)<br>1.0% ZnDTP (2) | 0.115 | 0.60 |
| 8 | 8% MoDTC (2)<br>1.5% ZnDTP (2) | 0.125 | 0.63 |
| 14 | 8% MoDTC (2)<br>3% ZnDTP (2) | 0.095 | 0.52 |
| 15 | 8% MoDTC (2)<br>4% ZnDTP (2) | 0.085 | 0.52 |

TABLE 5

Effect of progressively adding ZnNa (1) tc 8% MoDTC (2) in PUG

| | test grease | coefficient of friction | wear scar diameter (mm) |
|---|---|---|---|
| 12 | 8% MoDTC (2)<br>0% ZnNa (1) | 0.065 | 0.53 |
| 16 | 8% MoDTC (2)<br>0.5% ZnNa (1) | 0.075 | 0.59 |
| 17 | 8% MoDTC (2)<br>1% ZnNa (1) | 0.070 | 0.59 |
| 18 | 8% MoDTC (2)<br>2% ZnNa (1) | 0.075 | 0.55 |
| 1 | 8% MoDTC (2)<br>4% ZnNa (1) | 0.073 | 0.57 |

TABLE 6

Effect of varying the level of ZnDTP (2) and ZnNa (1) in a MoDTC (2)/ZnDTP (2)/ZnNa (1) additive mix in PUG

| | test grease | coefficient of friction | wear scar diameter (mm) |
|---|---|---|---|
| 13 | 8% MoDTC (2)<br>0% ZnNa (1)<br>1% ZnDTP (2) | 0.115 | 0.60 |
| 20 | 8% MoDTC (2)<br>1% ZnNa (1)<br>1% ZnDTP (2) | 0.083 | 0.65 |
| 21 | 8% MoDTC (2)<br>4% ZnNa (1)<br>1% ZnDTP (2) | 0.093 | 0.67 |
| 22 | 8% MoDTC (2)<br>0% ZnNa (1)<br>4% ZnDTP (2) | 0.085 | 0.52 |
| 23 | 8% MoDTC (2)<br>2% ZnNa (1)<br>4% ZnDTP (2) | 0.057 | 0.45 |
| 24 | 8% MoDTC (2)<br>4% ZnNa (1)<br>4% ZnDTP (2) | 0.060 | 0.45 |

TABLE 7

Effect of progressively adding MoDTC (2) to a 2:1 proportion of ZnNa (1) and ZnDTP (2) in PUG

| | test grease | coefficient of friction | wear scar diameter (mm) |
|---|---|---|---|
| 25 | 0% MoDTC (2)<br>4% ZnNa (1) | 0.113 | 0.56 |

TABLE 7-continued

Effect of progressively adding MoDTC (2) to a 2:1 proportion of ZnNa (1) and ZnDTP (2) in PUG

| | test grease | coefficient of friction | wear scar diameter (mm) |
|---|---|---|---|
| | 2% ZnDTP (2) | | |
| 26 | 4% MoDTC (2)<br>4% ZnNa (1)<br>2% ZnDTP (2) | 0.057 | 0.41 |
| 27 | 8% MoDTC (2)<br>4% ZnNa (1)<br>2% ZnDTP (2) | 0.058 | 0.46 |
| 28 | 12% MoDTC (2)<br>4% ZnNa (1)<br>2% ZnDTP (2) | 0.093 | 0.72 |

TABLE 8

Effect of varying the total level of additives of the MoDTC (2):ZnNa (1):ZnDTP (2) package (in PUG)

| | test grease | total level of additive | coefficient of friction | wear scar diameter (mm) |
|---|---|---|---|---|
| 29 | 2% MoDTC (2)<br>1% ZnNa (1)<br>0.5% ZnDTP (2) | 3.5% | 0.085 | 0.52 |
| 30 | 4% MoDTC (2)<br>2% ZnNa (1)<br>1.5% ZnDTP (2) | 7.5% | 0.058 | 0.47 |
| 27 | 8% MoDTC (2)<br>4% ZnNa (1)<br>2% ZnDTP (2) | 14% | 0.058 | 0.46 |

TABLE 9

Friction coefficients of experimental grease formulations in polyurea base grease

| Additive package (% mass)- | 27 | 32 | 31 |
|---|---|---|---|
| MoDTC (3) | — | 1.3 | 1.3 |
| MoDTC (2) | 8.0 | — | 8.0 |
| ZnDTP (2) | 2.0 | 2.0 | 2.0 |
| ZnNa (1) | 4.0 | 4.0 | 4.0 |
| molybdenum content (% mass) | 0.39 | 0.36 | 0.75 |
| SRV friction | 0.058 | 0.073 | 0.056 |
| Wear scar diameter (mm) | 0.46 | 0.51 | 0.46 |

TABLE 10

Effect of adding extreme pressure additives to the new package in PUG

| | test grease | coefficient of friction | wear scar diameter (mm) |
|---|---|---|---|
| 33 | 4% MoDTC (2)<br>2% ZnNa (1)<br>1% ZnDTP (2) | 0.048 | 0.58 |
| 34 | 4% MoDTC (2)<br>2% ZnNa (1)<br>1% ZnDTP (2)<br>1.5% sulphurised olefin | 0.055 | 0.52 |
| 35 | 4% MoDTC (12)<br>2% ZnNa (1)<br>1% ZnDTP (2)<br>1.5% Aminephos-phate/ thiophosphates | 0.055 | 0.58 |

TABLE 11

Effect of adding the new additive package to a lithium soap and a lithium complex base grease

| | test grease | coefficient of friction | wear scar diameter (mm) |
|---|---|---|---|
| 36 | 93% Lithium soap<br>4% MoDTC (2)<br>2% ZnNa (1)<br>1% ZnDTP (2) | 0.050 | 0.49 |
| 37 | 93% Lithium complex<br>4% MoDTC (2)<br>2% ZnNa (1)<br>1% ZnDTP (2) | 0.045 | 0.43 |

Lithium soap base grease

| | |
|---|---|
| thickener:- | 9.15% hydrogenated castor oil,<br>1.12% LiOH.H2O, |
| base oil comp:- | MVIN 170 (80%), HVI 170 (5%), HVI 105 (15%) |
| additive package:- | 0.5% diphenylamine |

Lithium complex base grease

| | |
|---|---|
| additive package: | 2% Vulkanox HS, 1% Irganox L101 |
| base oil composition: | 50% HVI-160B, 50% HVI 650 |
| thickener comp. (parts): | 7.7% hydrogenated castor oil<br>fatty acid<br>2.2% boric acid<br>2.6% $LiOH.H_2O$<br>1.5% calcium alkyl salicylate<br>1.5% calcium octoate |

TABLE 12

SRV friction without (Example 38) and with (Example 39) MoDTC (3) added in PUG

| Additive package (% mass):- | 38 | 39 |
|---|---|---|
| Barium sulphonate | 1.0 | 1.0 |
| ZnDTP (1) | 1.0 | 1.0 |
| ZnNa (1) | 2.0 | 2.0 |
| MoDTC (2) | 4.0 | 4.0 |
| MoDTC (3) | — | 2.0 |
| Base oil composition: 60% XHVI 5.2, 30% HVI 60, 10% MVIN 170 | | |
| antioxidant: diphenylamine | | |
| SRV friction | | |
| Friction coefficient:- | 0.050 | 0.053 |
| Wear Scar Diameter mm:- | 0.40 | 0.48 |

What is claimed is:

1. A lubricating composition comprising a base oil in combination with molybdenum dithiocarbamate, zinc napthenate and one or more metal dithiophosphates wherein the ratio of molybdenum in molybdenum dithiocarbamate to the total metal dithiophosphate is in the range of 2:1 to 1:20 and the ratio of the metal dithiophosphate to the amount of zinc naphthenate is in the range of 0.85:10 to 0.85:0.05 and the ratio of molybdenum in the molybdenum dithiocarbamate to zinc in zinc naphthenate is in the range 15:1 to 1:4.

2. The lubricating composition of claim 1 which further comprises one or more metal dithiocarbamates.

3. A lubricating grease comprising a thickener in combination with the lubricating composition of claim 1.

4. The lubricating grease of claim 3 which contains molybdenum from molybdenum dithiocarbamate in the amount of 0.04 to 2.5% by weight.

5. The lubricating grease of claim 3 which contains zinc naphthenate in the amount of 0.05 to 12.0% by weight.

6. The lubricating grease of claim 4 which contains zinc naphthenate in the amount of 0.05 to 12.0% by weight.

7. The lubricating grease of claim 3 which contains said one or more metal dithiophosphates in the total amount of 0.1 to 10% by weight.

8. The lubricating grease according to claim 3 wherein the thickener comprises a urea compound.

9. A method of lubricating a constant velocity joint comprising packing it with a lubricating grease according to claim 3.

10. A constant velocity joint packed with a lubricating grease according to claim 3.

11. A lubricating grease comprising a thickener in combination with the lubricating composition of claim 2.

12. The lubricating grease of claim 11 which contains molybdenum from molybdenum dithiocarbamate in the amount of 0.04 to 2.5% by weight.

13. The lubricating grease of claim 11 which contains zinc naphthenate in the amount of 0.05 to 12.0% by weight.

14. The lubricating grease of claim 12 which contains zinc naphthenate in the amount of 0.05 to 12.0% by weight.

15. The lubricating grease of claim 11 which contains said one or more metal dithiophosphates in the total amount of 0.1 to 10% by weight.

16. The lubricating grease according to claim 11 wherein the thickener comprises a urea compound.

TABLE 13

Friction coefficients of experimental grease formulations with MoDTC (3) in PUG

| | Example 41 | Example 42 | Example 43 | Example 44 | Example 45 | Example 46 |
|---|---|---|---|---|---|---|
| Key additives (% mass):- | | | | | | |
| MoDTC (3) | 3.0 | 3.0 | 3.0 | 3.0 | 3.0 | 3.0 |
| ZnDTP (2) | — | 1.5 | 1.5 | 1.5 | 1.5 | 1.5 |
| ZnNa (1) | — | — | 2.0 | — | 1.0 | 2.0 |
| ZnDTC | — | — | — | 1.5 | 1.5 | 1.5 |
| SRV friction | 0.138 | 0.065 | 0.053 | 0.075 | 0.053 | 0.050 |
| Base oil composition: | 75% HV1 160B<br>25% HV1 650<br>Antioxidant 0.5% | | | | | |

17. A method of lubricating a constant velocity joint comprising packing it with a lubricating grease according to claim 11.

18. A constant velocity joint packed with a lubricating grease according to claim 11.

* * * * *